US009953586B2

(12) United States Patent
Fan et al.

(10) Patent No.: US 9,953,586 B2
(45) Date of Patent: Apr. 24, 2018

(54) LIQUID CRYSTAL DISPLAY DEVICE AND DRIVING METHOD THEREOF

(71) Applicant: Shenzhen China Star Optoelectronics Technology Co., Ltd., Shenzhen, Guangdong (CN)

(72) Inventors: Yong Fan, Guangdong (CN); Chih Tsung Kang, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 18 days.

(21) Appl. No.: 14/417,858

(22) PCT Filed: Jan. 16, 2015

(86) PCT No.: PCT/CN2015/070923
§ 371 (c)(1),
(2) Date: May 9, 2016

(87) PCT Pub. No.: WO2016/106869
PCT Pub. Date: Jul. 7, 2016

(65) Prior Publication Data

US 2016/0247459 A1 Aug. 25, 2016

(30) Foreign Application Priority Data

Dec. 31, 2014 (CN) ..... 2014 1 0855281

(51) Int. Cl.
*G09G 3/34* (2006.01)
*G09G 3/36* (2006.01)

(52) U.S. Cl.
CPC ..... *G09G 3/3413* (2013.01); *G09G 3/36* (2013.01); *G09G 3/3607* (2013.01);
(Continued)

(58) Field of Classification Search
CPC ... G09G 2300/0443; G09G 2300/0452; G09G 3/3413; G09G 3/3607; G09G 2310/0235;
(Continued)

(56) References Cited

U.S. PATENT DOCUMENTS

2006/0214942 A1 9/2006 Tanase et al.
2016/0071449 A1* 3/2016 Miyata ..... G09G 3/3607 345/690

FOREIGN PATENT DOCUMENTS

CN 101443836 A 5/2009
CN 102682711 A 9/2012
(Continued)

OTHER PUBLICATIONS

International Search Report and Written Opinion, dated Jan. 16, 2015, China.

*Primary Examiner* — Abhishek Sarma
(74) *Attorney, Agent, or Firm* — Kim Winston LLP

(57) ABSTRACT

A liquid crystal display device and a driving method thereof are disclosed. The method for driving the liquid crystal display device comprises the following steps: converting three primary color gray-scale data of a frame image to be displayed into multiple color gray-scale data; and driving different sub pixels according to the overdrive gray-scale values that are obtained through inquiring the overdrive table based on the multiple color gray-scale data of the frame image to be displayed according to a certain time sequence in two color fields. According to the method, the color shift phenomena of the traditional liquid crystal display device can be alleviated effectively.

8 Claims, 4 Drawing Sheets

(52) U.S. Cl.
CPC ..... *G09G 2300/0443* (2013.01); *G09G 2300/0452* (2013.01); *G09G 2310/0235* (2013.01); *G09G 2320/0242* (2013.01); *G09G 2320/0666* (2013.01)

(58) Field of Classification Search
CPC ..... G09G 2320/0666; G09G 3/36; G09G 2320/0242
See application file for complete search history.

(56) References Cited

FOREIGN PATENT DOCUMENTS

| | | | |
|---|---|---|---|
| CN | 103137090 | A | 6/2013 |
| CN | 104006330 | A | 8/2014 |
| CN | 104019404 | A | 9/2014 |
| WO | 2014185109 | A1 | 11/2014 |

* cited by examiner

| Frame image | Backlight | T pixel gray-scale | G pixel gray-scale | B pixel gray-scale |
|---|---|---|---|---|
| 0 | 0 | 0 | 0 | 0 |
| | 0 | 0 | 0 | 0 |
| The first frame image | R | R1 | 0 | 0 |
| | W | W1 | G1 | B1 |
| The second frame image | R | R2 | W1 | W1 |
| | W | W2 | G2 | B2 |
| The third frame image | R | R3 | W2 | W2 |
| | W | W3 | G3 | B3 |
| ..... | ..... | ..... | ..... | ..... |

Fig. 5

| Target frame \ Current frame | 0 | 16 | 32 | 48 | 64 | 80 | 96 | 112 | 128 | 144 | 160 | 176 | 192 | 208 | 224 | 240 | 256 |
|---|---|---|---|---|---|---|---|---|---|---|---|---|---|---|---|---|---|
| 255 | 255 | 255 | 255 | 255 | 255 | 255 | 255 | 255 | 255 | 255 | 255 | 255 | 255 | 255 | 255 | 255 | 255 |
| 240 | 252 | 248 | 248 | 248 | 248 | 248 | 249 | 249 | 248 | 247 | 247 | 246 | 244 | 243 | 240 | 240 | 232 |
| 224 | 248 | 244 | 244 | 244 | 244 | 244 | 244 | 243 | 242 | 240 | 239 | 236 | 233 | 228 | 224 | 212 | 204 |
| 208 | 240 | 236 | 236 | 236 | 236 | 236 | 234 | 232 | 229 | 226 | 222 | 217 | 213 | 208 | 194 | 181 | 170 |
| 192 | 233 | 229 | 229 | 229 | 228 | 226 | 222 | 218 | 214 | 209 | 204 | 197 | 192 | 178 | 163 | 150 | 133 |
| 176 | 225 | 221 | 221 | 220 | 218 | 214 | 209 | 203 | 197 | 190 | 182 | 176 | 169 | 147 | 133 | 111 | 99 |
| 160 | 218 | 214 | 214 | 213 | 207 | 200 | 193 | 184 | 175 | 166 | 160 | 143 | 129 | 115 | 97 | 77 | 63 |
| 144 | 212 | 208 | 208 | 204 | 194 | 184 | 173 | 163 | 152 | 144 | 128 | 115 | 102 | 87 | 68 | 49 | 32 |
| 128 | 205 | 201 | 201 | 191 | 175 | 163 | 150 | 137 | 128 | 111 | 100 | 86 | 71 | 55 | 37 | 18 | 13 |
| 112 | 197 | 193 | 193 | 169 | 153 | 137 | 121 | 102 | 94 | 81 | 67 | 52 | 37 | 23 | 11 | 6 | 6 |
| 96 | 186 | 182 | 176 | 145 | 125 | 108 | 88 | 74 | 58 | 47 | 28 | 18 | 11 | 6 | 2 | 0 | 2 |
| 80 | 175 | 171 | 147 | 117 | 97 | 68 | 58 | 38 | 23 | 14 | 8 | 4 | 2 | 1 | 0 | 0 | 0 |
| 64 | 165 | 159 | 118 | 86 | 68 | 37 | 20 | 10 | 5 | 2 | 1 | 0 | 0 | 0 | 0 | 0 | 0 |
| 48 | 146 | 147 | 86 | 38 | 20 | 8 | 3 | 1 | 0 | 0 | 0 | 0 | 0 | 0 | 0 | 0 | 0 |
| 32 | 127 | 97 | 38 | 7 | 1 | 0 | 0 | 0 | 0 | 0 | 0 | 0 | 0 | 0 | 0 | 0 | 0 |
| 16 | 88 | 38 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 |

Fig. 6

LIQUID CRYSTAL DISPLAY DEVICE AND DRIVING METHOD THEREOF

CROSS REFERENCE TO RELATED APPLICATION

The present application claims benefit of Chinese patent application CN 201410855281.9, entitled "Liquid Crystal Display Device and Driving Method Thereof" and filed on Dec. 31, 2014, which is incorporated herein by reference.

FIELD OF THE INVENTION

The present disclosure relates to the technical field of liquid crystal display, and particularly to a liquid crystal display device and a driving method thereof.

BACKGROUND OF THE INVENTION

In order to improve a utilization rate of a backlight of a liquid crystal display device and reduce a light loss thereof, the liquid crystal display devices based on the display principle of Field Sequential Color (FSC) have been widely used in recent years.

FIG. 1 schematically shows the display principle of a TGB-FSC liquid crystal display device in the prior art, wherein TGB refer to transparent sub pixels, green sub pixels and blue sub pixels respectively. FIG. 1(*a*) schematically shows a first color field when a frame image is displayed, and FIG. 1(*b*) schematically shows a second color field when the frame image is displayed. Each display unit of the liquid crystal display device comprises two color filters and a transparent filter. As shown in FIG. 1, each frame image displayed on the liquid crystal display device is obtained through a combination of the first color field and the second color field.

Specifically, as shown in FIG. 1(*a*), when the first color field is presented, a white backlight is activated, and the transparent sub pixels, green sub pixels and blue sub pixels are all turned on. That is, liquid crystal molecules of each sub pixel are rotated accordingly under a voltage. White light transmits through the transparent sub pixels. Due to the color filters arranged at the green sub pixels and the blue sub pixels respectively, green light transmits through the green sub pixels, and blue light transmits through the blue sub pixels. In this case, the first color field has image information of white color, green color and blue color. When the second color field is presented, as shown in FIG. 1(*b*), the white backlight is deactivated, while a red backlight is activated. The green sub pixels and the blue sub pixels are both turned off, while the transparent sub pixels are maintained on a turn-on state. In this case, the red backlight only transmits through the transparent sub pixels, and thus the second color field has red color image information. At last, the first color field and the second color field enter into the eyes accordingly, and are combined into one frame image containing complete color information.

It is discovered during research that, in the FSC liquid crystal display device in the prior art, a color shift phenomena would occur. For example, when one frame image is displayed using white backlight and red backlight in an alternative manner, the image displayed therein would contain more red color ingredient than otherwise the color shift phenomenon does not occur. At the same time, it is discovered that the main reason for the color shift phenomenon is that the response time of liquid crystals is too long.

At present, some technical solutions have been proposed in order to solve the color shift problem, however, the technical effect thereof are not satisfactory. This is mainly because, in most of the current technical solution, the calculation amount is huge, and thus the execution speed is reduced. Consequently, when images are displayed on the liquid crystal display device, the fluency thereof would be affected. Meanwhile, since storage equipment with large capacity is needed for calculation and storage, the cost of the liquid crystal display device would increase inevitably.

In a word, in order to solve the aforesaid technical problem, a method through which the color shift phenomena of the liquid crystal display device can be eliminated in an effective and low cost manner is urgently needed.

SUMMARY OF THE INVENTION

One of the technical problems to be solved by the present disclosure is to provide a method through which the color shift phenomena of the liquid crystal display device can be eliminated or at least alleviated in an effective and low cost manner.

In order to solve the aforesaid technical problem, the embodiment of the present disclosure provides a method for driving a liquid crystal display device, comprising the following steps:

partitioning a backlight, and converting three primary color gray-scale data of a frame image to be displayed into multiple color gray-scale data, wherein multiple colors comprise three primary colors and a color different from the three primary colors; and presenting a first color field and a second color field of the frame image in sequence, wherein when each color field is presented, a backlight of a designated color of the multiple colors is taken as a backlight of the color field, the backlight being activated in sequence according to partitions, and wherein an overdrive table is inquired according to a color of the backlight of the color field, the multiple color gray-scale data of the frame image, and pre-stored gray-scale data to obtain overdrive gray-scale values, so that different sub pixels are driven according to said overdrive gray-scale values, the pre-stored gray-scale data comprising gray-scale data corresponding to said color different from the three primary colors of multiple color gray-scale data of a previous frame image.

Preferably, the method further comprises storing the gray-scale data corresponding to the color different from the three primary colors of multiple color gray-scale data of the frame image after the frame image is displayed and before a next frame image is displayed.

Preferably, the step that the backlight is activated in sequence according to the partitions specifically comprises:

determining brightness of different partitions, and activating the backlight of the partitions in sequence according to the brightness thereof.

Preferably, when the first color field of the frame image is presented, a backlight of one color of the three primary colors is taken as a backlight of the color field, the backlight being activated in sequence according to the partitions, and wherein the overdrive gray-scale values obtained according to gray-scale data of a color the same as a color of the backlight of the multiple color gray-scale data of the frame image are output to transparent sub pixels, and the overdrive gray-scale values obtained according to the pre-stored gray-scale data are output to other sub pixels.

Preferably, when the second color field of the frame image is presented, a backlight of the color different from the three primary colors is taken as a backlight of the color field, the backlight being activated in sequence according to the partitions, and wherein the overdrive gray-scale values obtained according to gray-scale data of a color the same as a color of the backlight of the multiple color gray-scale data of the frame image are output to transparent sub pixels, and the overdrive gray-scale values obtained according to gray-scale data corresponding to colors of other sub pixels are output to other sub pixels.

Preferably, when the frame image to be displayed is a first frame image, the pre-stored gray-scale data is zero.

Preferably, brightness of the backlight of the color different from the three primary colors is lower than brightness of the backlight of one color of the three primary colors.

Preferably, the color different from the three primary colors is white color or cyan color.

Preferably, the method further comprises substituting the pre-stored gray-scale data with the gray-scale data corresponding to the color different from the three primary colors of multiple color gray-scale data of the frame image.

According to another aspect of the present disclosure, a liquid crystal display device which is driven by the above method is further provided.

Compared with the prior art, one embodiment or a plurality of embodiments according to the present disclosure may have the following advantages or beneficial effects.

According to the embodiment of the present disclosure, the overdrive gray-scale values can be obtained through inquiring the overdrive table based on the multiple color gray-scale data of the frame image to be displayed according to a certain time sequence in two color fields, and then output to each sub pixel respectively, whereby the color shift phenomena of the liquid crystal display device can be alleviated. Moreover, the method for driving the liquid crystal display device with no color shift also has the advantages of small storage data amount, high calculation speed, and low cost.

Other features and advantages of the present disclosure will be further explained in the following description, and partially become self-evident therefrom, or be understood through the embodiments of the present disclosure. The objectives and advantages of the present disclosure will be achieved through the structure specifically pointed out in the description, claims, and the accompanying drawings.

BRIEF DESCRIPTION OF THE DRAWINGS

The accompanying drawings provide further understandings of the present disclosure and constitute one part of the description. The drawings are used for interpreting the present disclosure together with the embodiments, not for limiting the present disclosure. In the drawings:

FIG. 5 schematically shows a principle of the method for driving the liquid crystal display device to eliminate the color shift thereof according to the embodiment of the present disclosure;

FIG. 6 schematically shows an overdrive table corresponding to red color.

DETAILED DESCRIPTION OF THE EMBODIMENTS

The present disclosure will be explained in details with reference to the embodiments and the accompanying drawings, whereby it can be fully understood how to solve the technical problem by the technical means according to the present disclosure and achieve the technical effects thereof, and thus the technical solution according to the present disclosure can be implemented. It should be noted that, as long as there is no structural conflict, all the technical features mentioned in all the embodiments may be combined together in any manner, and the technical solutions obtained in this manner all fall within the scope of the present disclosure.

Figure 1:
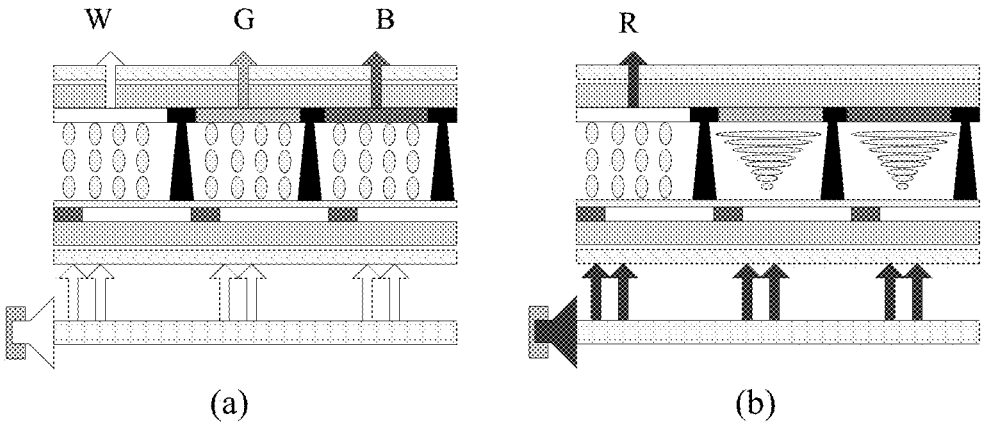
FIG. 1 schematically shows a display principle of a TGB-FSC liquid crystal display device in the prior art, wherein FIG. 1(*a*) schematically shows a first color field when a frame image is displayed, and FIG. 1(*b*) schematically shows a second color field when the frame image is displayed.
Figure 2:
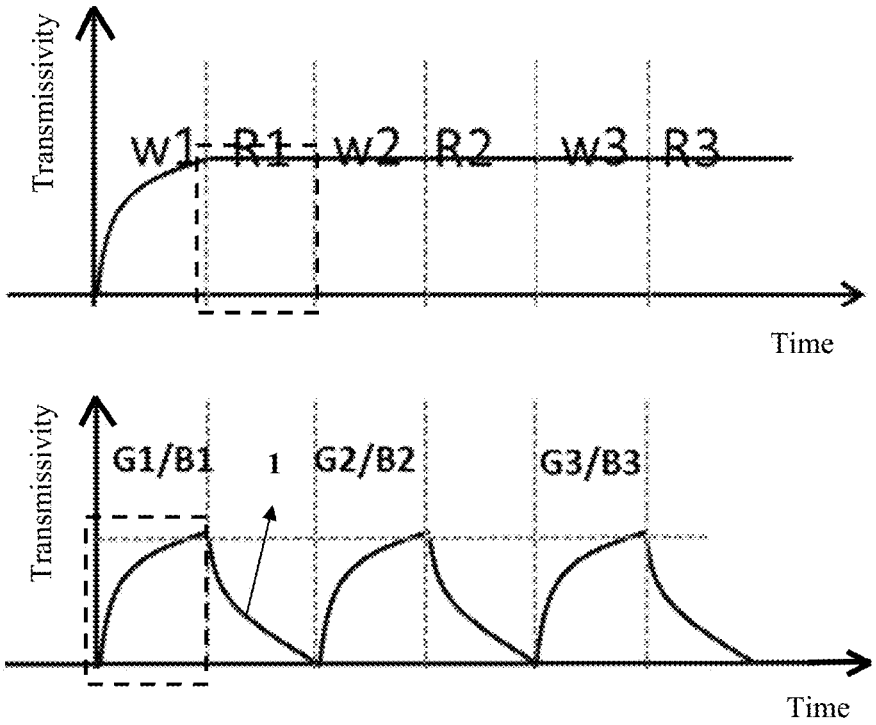
FIG. 2 schematically shows a liquid crystal response of each sub pixel of the TGB-FSC liquid crystal display device in the prior art when GB black frame insertion is applied.

FIG. 2 schematically shows a liquid crystal response of each sub pixel of a TGB-FSC liquid crystal display device in the prior art when GB black frame insertion is applied, wherein GB refer to green sub pixels and blue sub pixels respectively. The reason for color shift phenomena of a liquid crystal display device in the prior art will be illustrated below with reference to FIG. 2.

As shown in FIG. 2, a first group of curves in an upper figure represent a transmissivity of transparent sub pixels T, and a second group of curves in a lower figure represent a transmissivity of green sub pixels G and blue sub pixels B. When a frame image is displayed according to a method in the prior art, first, a first color field is presented, a white backlight is activated, and then, the transparent sub pixels T, green sub pixels G and blue sub pixels B are all turned on. It is assumed that the gray-scale values of the three kinds of sub pixels to be reached are all 128. Since the response of liquid crystal needs a certain time, when the first color field is presented, a liquid crystal response process of the transparent sub pixels T is shown by curve W1 in FIG. 2, and a liquid crystal response process of the green sub pixels G and blue sub pixels B is shown by curve G1/B1 in FIG. 2.

After a scanning of the first color field is completed, a second color field of the frame image is presented, and the backlight is converted from white into red. The transparent sub pixels T is turned on, while the green sub pixels G and blue sub pixels B are both turned off. Since the transparent sub pixels T have reached 128 gray-scale when the first color field is presented before, a liquid crystal response process of the transparent sub pixels T is shown by curve R1 (i.e., a curve of the first group of curves in a dotted line box of the upper figure) in FIG. 2, which does not change greatly. A liquid crystal turned-off process of the green sub pixels G and blue sub pixels B is shown by curve 1 of the second group of curves in the lower figure of FIG. 2. After a scanning of the second color field is completed, the display of the frame image can be realized.

It can be seen from further analysis that, red color information of the frame image is formed through transmission during a time period in the dotted line box of the first group of curves in the upper figure of FIG. 2, while green color information and blue color information are both formed through transmission during a time period in a dotted line box of the second group of curves in the lower figure of FIG. 2. It can be understood that, a turn-on process of the transparent sub pixels is no longer necessary when the red color information is displayed, while turn-on processes of the corresponding sub pixels are still necessary when the green color information and blue color information are displayed at each time. Since the response time of liquid crystal is relatively long, the turn-on process of sub pixels cannot be neglected compared with the duration of a color field. In this case, the transmissivity of the transparent sub pixels when the red color information is displayed is higher than the transmissivity of the green sub pixels and the blue sub pixels when the corresponding color information is displayed, and thus the image would contain more red color ingredient on the whole.

In order to solve the color shift problem of the traditional FSC liquid crystal display device, the embodiment of the present disclosure provides a novel driving method. In the driving method, with respect to one frame image, gray-scale calculation is performed, and the frame image can be displayed using pre-stored gray-scale information of a previous frame image. The color shift phenomena can be alleviated effectively through the above method.

Figure 3:
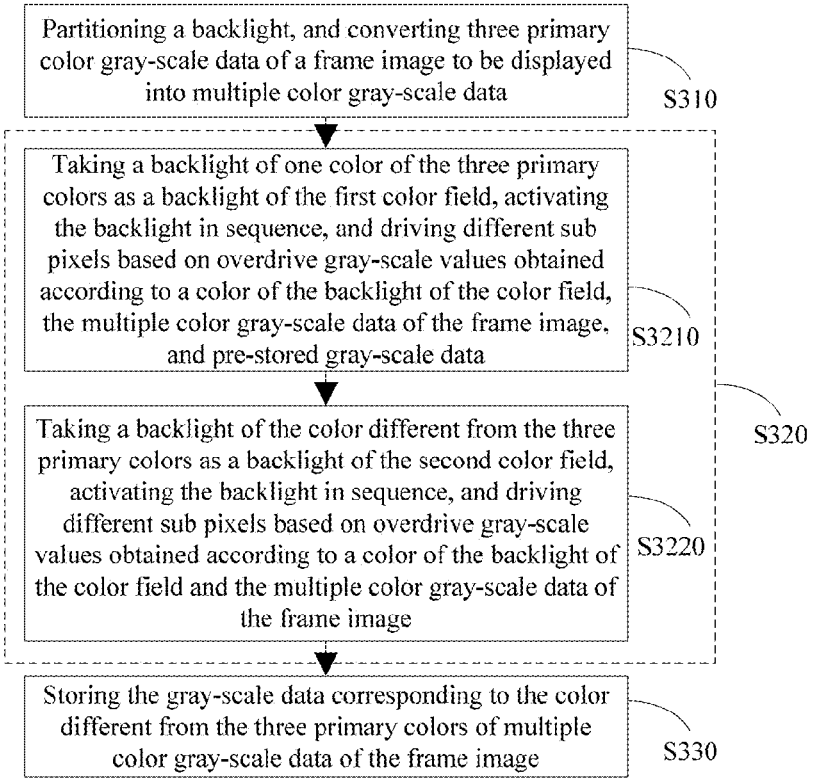
FIG. 3 is a flow chart of a method for driving a liquid crystal display device according to an embodiment of the present disclosure.

FIG. 3 is a flow chart of a method for driving a liquid crystal display device according to an embodiment of the present disclosure. The steps of the present embodiment will be illustrated in detail hereinafter with reference to FIG. 3.

In step S310, a backlight is partitioned, and three primary color (RGB) gray-scale data of a frame image to be displayed is converted into multiple color gray-scale data, wherein multiple colors comprise the three primary colors and a color different from the three primary colors, and RGB represent red color, green color, and blue color respectively.

Specifically, the RGB gray-scale data (which is a data group in general) of a frame image to be displayed is converted into XR'G'B' gray-scale data according to a certain conversion algorithm, wherein X represents the color different from the three primary colors. According to the present embodiment, the multiple colors comprise four colors, i.e., the three primary colors and white color. That is, X is white color, which can be represented by W.

For example, if the RGB gray-scale data of one pixel of one frame image is (63, 127, 191), the WR'G'B' gray-scale data obtained after conversion is (66, 0, 119, 191).

Of course, in other embodiments, X can be arranged to be cyan, which can be represented by C. The cyan color being selected as the color different from the three primary colors would facilitate the expanding of the color gamut of the liquid crystal display device, and thus the image displayed therein would become more colorful.

When one frame image is displayed through two color fields, the three primary color information is actually formed after transmission through different color fields. Taking the multiple colors WRGB as an example again, it can be understood from the steps of the method according to the embodiment of the present disclosure that, the information corresponding to the red color is formed after transmission through the first color field, while the information corresponding to the green color and the blue color is formed after transmission through the second color field. Therefore, the phenomenon that the image contains more red color ingredient can be alleviated through controlling the brightness of the backlight when the red color information is formed after transmission, as well as the green color information and the blue color information is formed after transmission respectively. Furthermore, the backlight can be controlled through partitioning, whereby not only the color shift phenomena can be alleviated, but also the power consumption thereof can be reduced, the picture contrast can be increased, and thus the display effect of the liquid crystal display device can be improved.

Different degrees of brightness of the backlight corresponding to different partitions thereof can be obtained through analyzing and calculating the three primary color gray-scale values of the image to be displayed input therein. When the scanning of each partition of each color field is performed in sequence, the backlight is activated according to the different degrees of brightness of different partitions. There are various methods to determine the brightness of a partition. For example, a maximum value or an average value of the RGB gray-scale values of each partition can serve as the brightness of the backlight, or a statistical value obtained through statistics method can also serve as the brightness of the backlight. Of course, various methods for determining the brightness of the partition can be combined.

In addition, the partition method and partition number of a backlight can be determined taking the display effect of the liquid crystal display device, a complexity of a partitioning scanning algorithm and a driving cost, as well as other aspects into overall consideration, and are not limited by the method and number recited below according to the present embodiment.

Figure 4:
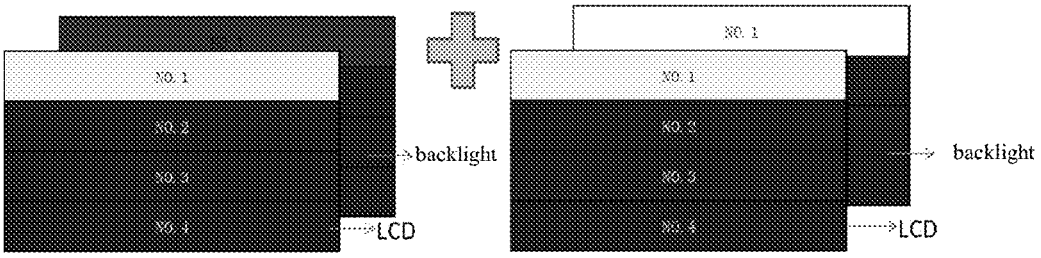
FIG. 4 schematically shows partitions of a backlight and the backlight being activated according to the embodiment of the present disclosure.

FIG. 4 schematically shows partitions of a backlight and the backlight being activated according to the embodiment of the present disclosure. As shown in FIG. 4, a front panel represents a screen of the liquid crystal display, and a back panel represents the backlight. The backlight is divided into four partitions along a row scanning direction, and the screen of the liquid crystal display is divided accordingly. It can be understood that, a sequential control should be performed on a partition of the backlight and the corresponding partition of the liquid crystal display screen, so that the synchronization of the corresponding partitions can be realized.

In step S320, a first color field and a second color field of the frame image are presented in sequence, wherein when each color field is presented, a backlight of a designated color of the multiple colors is taken as a backlight of the color field, the backlight is activated in sequence according to the partitions, an overdrive table is inquired according to a color of the backlight of the color field, the multiple color gray-scale data of the frame image, and pre-stored gray-scale data to obtain overdrive gray-scale values, so that different sub pixels are driven according to said overdrive gray-scale values.

Specifically, the step S320 comprises sub steps S3210 and S3220.

In sub step S3210, when the first color field of the frame image is presented, a backlight of one color of the three primary colors is taken as the backlight of the color field, the backlight is activated in sequence according to the partitions, the overdrive gray-scale values obtained through inquiring an overdrive table according to gray-scale data of a color, which is the same as the color of the backlight, of the multiple color gray-scale data of the frame image are output to transparent sub pixels, and the overdrive gray-scale values obtained through inquiring the overdrive table according to the pre-stored gray-scale data are output to other sub pixels.

In order to better illustrate the sub step S3210, a scanning process of the first color field will be described below with reference to FIG. 5, taking the multiple colors comprising the three primary colors RGB and the white color W as an example.

It is assumed that the image to be displayed is a second frame image.

Specifically, when the second frame image is displayed, the first color field is presented at first. A backlight of red color (i.e., one color of the three primary colors) is taken as the backlight of the color field, and the red backlight is activated. As shown by the data in row five of the "backlight" column of FIG. 5, R represents that the red backlight is activated. Then, the gray-scale data corresponding to the red color of the second frame image is output to transparent sub pixels T as the gray-scale value, and the pre-stored gray-scale data is output to green sub pixels G and blue sub pixels B as the gray-scale value respectively.

It should be noted that, the pre-stored gray-scale data comprises gray-scale data corresponding to said color different from the three primary colors of multiple color gray-scale data of a previous frame image. Specifically, according to the present embodiment, the pre-stored gray-scale data refers to gray-scale data corresponding to said color different from the three primary colors of a first frame image which is stored before the second frame image is displayed, i.e., the white color gray-scale data W1 of the first frame image.

The execution results of the above steps are shown by the data in row five of FIG. 5, wherein the gray-scale of the transparent sub pixels T is R2, the gray-scale of the green sub pixels G is W1, and the gray-scale of the blue sub pixels B is W1 as well.

In addition, it should be noted that, when the frame image to be displayed is the first frame image, the pre-stored gray-scale data, i.e., the gray-scale data of the previous frame image, is zero.

Then, the overdrive table is inquired according to the gray-scale value corresponding to each color obtained therein, so that the overdrive gray-scale value that each sub pixel needed during actual driving can be obtained.

FIG. 6 schematically shows an overdrive table corresponding to red color. As shown in FIG. 6, a target frame represents gray-scale values corresponding to the red color of a frame image to be displayed, i.e., the color field to be presented for the FSC liquid crystal display device; and a current frame represents gray-scale values corresponding to the red color of a previous frame image of the frame image to be displayed (which is actually the frame image being displayed at present), i.e., the color field being presented for the FSC liquid crystal display device at present. For example, if the gray-scale value of the transparent sub pixels (through which the red color information is displayed) of the frame image to be displayed is 80, and the gray-scale value corresponding to the red color of the previous frame image is 16, then it can be obtained from the overdrive table that the overdrive gray-scale value of the transparent sub pixels is 171.

In addition, it should be noted that, the overdrive table schematically shows the pre-stored gray-scale relations between the frame image to be displayed and a previous frame image. There are three kinds of overdrive tables corresponding to the red color, the green color, and the blue color respectively. According to the embodiment of the present disclosure, the white color information and the red color information are both formed after transmission through the transparent sub pixels, and therefore, the white color and the red color correspond to a same overdrive table.

At last, the four partitions of the backlight are activated in sequence, and the scanning of the display panel is performed correspondingly in respective partitions, so that the first color field of the frame image can be presented.

In sub step S3220, when the second color field of the frame image is presented, a backlight of the color different from the three primary colors is taken as the backlight of the color field, the backlight is activated in sequence according to the partitions, the overdrive gray-scale values obtained through inquiring the overdrive table according to gray-scale data of a color, which is the same as the color of the backlight, of the multiple color gray-scale data of the frame image are output to transparent sub pixels, and the overdrive gray-scale values obtained through inquiring the overdrive table according to gray-scale data corresponding to colors of other sub pixels are output to other sub pixels.

Specifically, reference can be still made to FIG. 5, wherein the second frame image is also taken as an example, and a backlight of the color different from the three primary colors, i.e., the white backlight, is taken as the backlight of the second color field. After the scanning of the first color field is completed, the second color field of the frame image is presented. That is, the red backlight of the first color field is deactivated, and the white backlight is activated. As shown by the data in row six of the "backlight" column of FIG. 5, W represents that the white backlight is activated. At the same time, the gray-scale data corresponding to the white color of the second frame image is output to the transparent sub pixels T as the gray-scale value, the gray-scale data corresponding to green color is output to the green sub pixels G as the gray-scale value, and the gray-scale data corresponding to blue color is output to the blue sub pixels B as the gray-scale value. As shown by the data in row six of FIG. 5, the gray-scale of the transparent sub pixels T is W2, the gray-scale of the green sub pixels G is G2, and the gray-scale of the blue sub pixels B is B2.

Then, the overdrive table is inquired according to the gray-scale value obtained therein, so that the overdrive gray-scale value that each sub pixel needed during actual driving can be obtained. At last, the four partitions of the backlight are activated in sequence, and the scanning of the display panel is performed correspondingly in respective partition, so that the second color field of the frame image can be presented.

When the scanning of the second color field comes to an end, the present of the second frame image is completed. The second frame image can be combined by the eyes taking advantage of the persistence of vision and based on the information received in sequence therein.

It should be noted that, when the first color field of one frame image is presented, the gray-scale data corresponding to a color different from the three primary colors of the pre-stored multiple color gray-scale data of a previous frame image being output to other sub pixels would not result in that the present result of the first color field goes wrong. This is because, although the green sub pixels and the blue sub pixels are both turned on with a certain gray-scale in the first color field, the red backlight cannot transmit through the green sub pixels and the blue sub pixels due to the color filters arranged at the green sub pixels and the blue sub pixels respectively.

The scanning processes of the first color field and the second color field are performed according to the above steps, whereby the color shift phenomena as shown in FIG. 2 can be eliminated effectively. The reasons will be stated below with reference to FIGS. 2 and 5 simultaneously.

In the prior art, the main reason for the color shift phenomenon is that the response time of liquid crystal is long. According to the embodiment of the present disclosure, in the overdrive method of the liquid crystal display panel to alleviate the color shift thereof, the gray-scale response time of liquid crystal can be reduced significantly. On the one hand, in the two color fields of one frame image, the original gray-scale value of liquid crystal of each of the sub pixels, through which the three primary color (RGB) information is formed after transmission, is the same with one another.

Specifically, as shown by the data in rows four, five and six of FIG. 5, when the second frame image is displayed, the red color information is formed after transmission through the transparent sub pixels in the first color field, and the original gray-scale value of the transparent sub pixels is W1; and the green color information and the blue color information are formed after transmission through the green sub pixels and the blue sub pixels respectively in the second color field, and the original gray-scale of the green sub pixels is the same as that of the blue sub pixels, which is W1. That is, the liquid crystals of the three kinds of sub pixels all change into a next state from the same gray-scale value W1. In this manner, it can be guaranteed that the gray-scale response time of the liquid crystals at each of the sub pixels is equal to one another roughly during the process of the three primary color information of the second frame image being formed after transmission. Therefore, the color shift phenomena resulted from the relatively long response time of liquid crystal can be alleviated effectively.

On the other hand, based on the condition that the original gray-scale value of liquid crystal of each of the sub pixels, through which the three primary color (RGB) information is formed after transmission, is the same with one another in combination with the overdrive method, the response speed of the liquid crystal in each of the sub pixels during turn-on and turn-off processes as shown in FIG. 2 can be improved. That is, each sub pixel can reach the needed gray-scale value more quickly, so that the influence brought about by the color shift phenomena can be reduced. In this case, when the liquid crystal display device is driven based on the overdrive gray-scale values which are obtained through inquiring the overdrive table according to the above gray-scale values, the ratio of the response time of liquid crystal during turn-on and turn-off processes to the display time of the whole frame image can be reduced. Hence, the color shift phenomena resulted from the long response time of liquid crystal can be alleviated effectively even if the gray-scale values of the sub pixels in target states are different from one another.

In addition, it should be noted that, a brightness of the backlight of the color different from the three primary colors is lower than a brightness of the backlight of one color of the three primary colors. Specifically, in the TGB display scheme, the brightness of the white backlight is lower than the brightness of the red backlight. In this case, not only the color shift phenomena can be alleviated, but also the power consumption of the device can be reduced.

Figure 7:
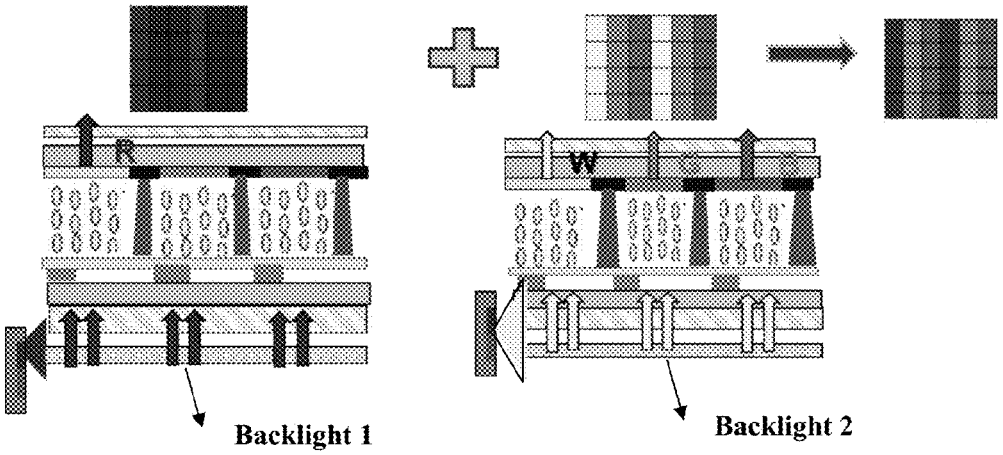
FIG. 7 schematically shows a display principle of a TGB-FSC liquid crystal display device which is driven by the method according to the embodiment of the present disclosure.

FIG. 7 schematically shows a display principle of a TGB-FSC liquid crystal display device which is driven by the method according to the embodiment of the present disclosure. According to the steps of the method of the embodiment of the present disclosure, in the first color field of one frame image, the red backlight is activated first (as shown by "backlight 1" in FIG. 7), then each of the sub pixels is driven, and the red color information is formed after transmission through the transparent sub pixels (as shown by R in FIG. 7); and in the second color field of the frame image, the white backlight is activated (as shown by "backlight 2" in FIG. 7), then each of the sub pixels is driven, and the white color information, the green color information, and the blue color information are formed after transmission through the transparent sub pixels, the green sub pixels, and the blue sub pixels respectively (as shown by W, G, and B in FIG. 7). At last, the first color field and the second color field enter into the eyes and are combined into one frame image with RGB color information.

In step S330, the gray-scale data corresponding to the color different from the three primary colors of multiple color gray-scale data of the frame image is stored.

Specifically, the gray-scale data corresponding to the color different from the three primary colors of multiple color gray-scale data of the frame image is stored after the frame image is displayed and before a next frame image is displayed.

For example, as shown in FIG. 5, it is assumed that the display of the second frame image is completed after steps S310 and S320, and then the gray-scale data W2 is stored. That is, the gray-scale data is stored after the current frame image is displayed and before a next frame image is displayed.

Preferably, in order to save the storage space, the pre-stored gray-scale data, i.e., the gray-scale data corresponding to the color different from the three primary colors of multiple color gray-scale data of the previous frame image, can be substituted with the gray-scale data corresponding to the color different from the three primary colors of multiple color gray-scale data of the frame image. Of course, in other embodiments, the gray-scale data corresponding to the color different from the three primary colors of multiple color gray-scale data of each frame image can be stored respectively in a form of a table.

Then, the display method of the third frame image is the same as that of the second frame image. If the gray-scale data corresponding to the color different from the three primary colors of multiple color gray-scale data is stored through substituting the data of the previous frame image, the stored gray-scale data corresponding to the color different from the three primary colors of multiple color gray-scale data of the previous frame image is updated to W2 before a first color field of the third frame image is presented. In this case, in the first color field of the third frame image, W2 is output as the gray-scale of the green sub pixels and the blue sub pixels, the details of which are no longer repeated here.

In addition, since 60 frame images being displayed in one second is the lowest standard of fluency for the eyes, at present, the image refresh rate that 60 frame images are displayed in one second is widely used in the traditional liquid crystal display devices. Therefore, the image refresh rate of the liquid crystal display device which is driven according to the method of the present embodiment is higher than or equal to 120 Hz. That is, the switching frequency of the first color field and the second color field is higher than or equal to 120 Hz.

Compared with the prior art, the driving method according to the embodiment of the present disclosure can alleviate the color shift phenomena effectively from the following two aspects. First, the gray-scale response time of liquid crystal can be shortened through the overdrive method; and second, the influence of the color shift phenomena can be reduced through compensating the brightness of the backlight.

According to the embodiment of the present disclosure, the driving method not only can alleviate the color shift phenomena effectively, but also has the advantages of small data amount and high calculation speed when the gray-scale values which drive each of the sub pixels are calculated. Meanwhile, only the gray-scale data of one frame image needs to be calculated during the calculation, and the stored multiple color gray-scale data of the previous frame image can be used. In this manner, the storage data amount and the cost can be reduced significantly, the processing speed can be accelerated, and thus the fluency of the images can be improved.

It should be noted that, although the steps of the method for driving the liquid crystal display device to alleviate the color shift thereof are illustrated taking the TGB-FSC liquid crystal display device as an example, the present method is applicable for other types of liquid crystal display devices. For example, the present method is applicable for the liquid crystal display devices with RTB or RGT pixel design to alleviate the color shift problem that the image contains more green color ingredient or blue color ingredient, wherein RTB represent red sub pixels, transparent sub pixels, and blue sub pixels respectively, and RGT represent red sub pixels, green sub pixels, and transparent sub pixels respectively.

The above embodiments are described only for better understanding, rather than restricting, the present disclosure. Any person skilled in the art can make amendments to the implementing forms or details without departing from the spirit and scope of the present disclosure. The protection scope of the present disclosure shall be determined by the scope as defined in the claims.

The invention claimed is:

1. A liquid crystal display device, which is driven through a driving method comprising the following steps:

partitioning a backlight, and converting three primary color gray-scale data of a frame image to be displayed into multiple color gray-scale data, wherein multiple colors comprise three primary colors and a color different from the three primary colors; and presenting a first color field and a second color field of the frame image in sequence, wherein when the first color field of the frame image is presented, a backlight of one color of the three primary colors is taken as a backlight of the first color field, the backlight being activated in sequence according to the partitions, and wherein overdrive gray-scale values obtained according to gray-scale data of a color, which is the same as a color of the backlight of the multiple color gray-scale data of the frame image are output to transparent sub pixels, and overdrive gray-scale values obtained according to the pre-stored gray-scale data are output to other sub pixels, wherein when the second color field of the frame image is presented, a backlight of the color different from the three primary colors is taken as a backlight of the second color field, the backlight being activated in sequence according to the partitions, and wherein the overdrive gray-scale values obtained according to gray-scale data of a color, which is the same as a color of the backlight of the multiple color gray-scale data of the frame image are output to transparent sub pixels, and overdrive gray-scale values obtained according to gray-scale data corresponding to colors of other sub pixels are output to other sub pixels, and wherein the pre-stored gray-scale data comprises gray-scale data corresponding to said color different from the three primary colors of multiple color gray-scale data of a previous frame image.

2. A method for driving a liquid crystal display device, comprising the following steps:

partitioning a backlight, and converting three primary color gray-scale data of a frame image to be displayed into multiple color gray-scale data, wherein multiple colors comprise three primary colors and a color different from the three primary colors; and presenting a first color field and a second color field of the frame image in sequence, wherein when the first color field of the frame image is presented, a backlight of one color of the three primary colors is taken as a backlight of the first color field, the backlight being activated in sequence according to the partitions, and wherein overdrive gray-scale values obtained according to gray-scale data of a color, which is the same as a color of the backlight of the multiple color gray-scale data of the frame image are output to transparent sub pixels, and overdrive gray-scale values obtained according to pre-stored gray-scale data are output to other sub pixels, wherein when the second color field of the frame image is presented, a backlight of the color different from the three primary colors is taken as a backlight of the second color field, the backlight being activated in sequence according to the partitions, and wherein the overdrive gray-scale values obtained according to gray-scale data of a color, which is the same as a color of the backlight of the multiple color gray-scale data of the frame image are output to transparent sub pixels, and overdrive gray-scale values obtained according to gray-scale data corresponding to colors of other sub pixels are output to other sub pixels, and wherein the pre-stored gray-scale data comprises gray-scale data corresponding to said color different from the three primary colors of multiple color gray-scale data of a previous frame image.

3. The method according to claim 2, further comprising storing the gray-scale data corresponding to the color different from the three primary colors of multiple color gray-scale data of the frame image after the frame image is displayed and before a next frame image is displayed.

4. The method according to claim 2, wherein the step that the backlight is activated in sequence according to the partitions specifically comprises: determining brightness of different partitions, and activating the backlight of the partitions in sequence according to the brightness thereof.

5. The method according to claim 2, wherein when the frame image to be displayed is a first frame image, the pre-stored gray-scale data is zero.

6. The method according to claim 2, wherein brightness of the backlight of the color different from the three primary colors is lower than brightness of the backlight of one color of the three primary colors.

7. The method according to claim 2, wherein the color different from the three primary colors is white color or cyan color.

8. The method according to claim 3, further comprising substituting the pre-stored gray-scale data with the gray-scale data corresponding to the color different from the three primary colors of multiple color gray-scale data of the frame image.

* * * * *